United States Patent [19]

Burgess

[11] Patent Number: 4,475,064

[45] Date of Patent: Oct. 2, 1984

[54] MEANS FOR CONTROLLING LUMEN OUTPUT IN POWER CONSUMPTION OF PHOSPHOR EXCITABLE LAMPS

[76] Inventor: David E. Burgess, 1341 W. 130th St., Gardena, Calif. 90247

[21] Appl. No.: 329,673

[22] Filed: Dec. 11, 1981

Related U.S. Application Data

[63] Continuation-in-part of Ser. No. 116,573, Jan. 29, 1980, Pat. No. 4,317,069.

[51] Int. Cl.[3] ..... H05B 41/16

[52] U.S. Cl. ..... 315/227 R; 315/58; 315/187; 315/DIG. 4; 339/50 R

[58] Field of Search ..... 315/58, 71, 187, 227 R, 315/291, DIG. 4; 339/50 R

[56] References Cited

U.S. PATENT DOCUMENTS

| | | | |
|---|---|---|---|
| 3,956,665 | 5/1976 | Westphal | 315/187 |
| 3,989,335 | 11/1976 | Belokin | 339/50 R |
| 4,053,811 | 10/1977 | Abernethy | 315/312 X |
| 4,135,115 | 1/1979 | Abernethy et al. | 315/97 |
| 4,163,176 | 7/1979 | Cohen et al. | 315/58 |

*Primary Examiner*—Eugene R. LaRoche
*Attorney, Agent, or Firm*—Robert J. Schaap

[57] ABSTRACT

A device and a method for reducing power consumption and correspondingly reducing lumen output of a phosphor excitable lamp, such as a fluorescent lamp, connected to a source of power for operation of the same, without any appreciable loss of operating efficiency. A load limiting arrangement, often referred to as a load limiting control device, and which generally includes a capacitive element is electrically connectable to one terminal of the phosphor excitable lamp. This device, when connected, is effectively electrically interposed between the lamp and the source of power in a series connection. The capacitive element is selected with a capacitive value so that the lumen output is reduced but with substantially uniform lumen output at the reduced level and the power consumption is reduced without substantially changing the voltage to the lamp and without any appreciable effects on the efficiency of operation of the lamp or the source of power. Further, when using the device and method, a circuit path is not created directly between the conductive terminal of the socket and the end terminal of the lamp, but rather through the capacitive element to thereby reduce the power consumption and lumen output. In addition the load limiting arrangement may adopt the form of a capacitive inductive circuit arrangement. In a preferred embodiment, the device is constructed so that conductive pins on the device is inserted in the pin receptacles of the fixture and pin receptacles on the device are offset to receive the pins on the lamp.

26 Claims, 19 Drawing Figures

MEANS FOR CONTROLLING LUMEN OUTPUT IN POWER CONSUMPTION OF PHOSPHOR EXCITABLE LAMPS

RELATED APPLICATION

This application is a continuation-in-part of U.S. patent application Ser. No. 116,573, filed Jan. 29, 1980, for "MEANS AND METHOD FOR CONTROLLING LUMEN OUTPUT AND POWER CONSUMPTION OF PHOSPHOR EXCITABLE LAMPS", (Now U.S. Pat. No. 4,317,069 dated Feb. 23, 1982).

BACKGROUND OF THE INVENTION

1. Field of the Invention

This invention relates in general to certain new and useful improvements in a means and method for reducing power consumption of one or more lamps in a circuit arrangement and correspondingly reducing lumen output to a uniform lumen output level, while maintaining efficiency of operation of the lamps and the power source connected to the lamps for operation of the lamps, and more particularly to a means and method of the type stated which utilizes a load limiting control means for insertion in a series connection with respect to a lamp and the source of power thereof.

2. Brief Description of the Prior Art

In many cases, conventional fluorescent light fixtures are constructed so as to physically retain and energize a pair of phosphor excitable lamps, such as the fluorescent lamps. The ballast and circuitry in these fixtures are typically designed so that two lamps in a two-lamp fixture, for example, are essentially electrically 180 degrees out of phase. This arrangement is used in order to cancel out visible flicker to some extent. Thus, two lights in a fixture or otherwise lights in pairs are employed to reduce the noticeable effects of flicker, even though the extra lumen output of the two lamps are not necessarily required.

In many cases, it has been found in office buildings and other commercial installations, that it is possible to eliminate one or more lamps of the fixture without appreciably reducing total light output so that inefficiency and eye fatigue do not result. In other words, many commercially available fixtures were constructed so that an excess of light was generated for a given purpose.

In recent years, and due at least in part to severe shortages in available energy, and particularly electrical energy, and also due to the high cost of electrical energy, there has been an interest in reducing the available light output in order to reduce the total cost of operation. However, in many of the commercially available fluorescent lamp fixtures, the removal of one of the lamps, particularly in a series connected circuit of the lamps resulted in a very substantial inefficiency of operation. If the remaining lamp was able to operate at all, depending upon the circuit configuration, then there was a resultant inefficiency in that the remaining lamp produced less light output for a given level of power consumption, or otherwise, the ballast in the electrical circuit which operates the lamp operated inefficiently thereby decreasing operating life.

In order to obviate these problems, there has been an introduction in the market place of the so-called "phantom tube". The phantom tube is essentially a bulb or tube similar to that of the fluorescent lamp or similar phosphor excitable lamp which was removed and which is capable of being connected between the terminals in a fluorescent lamp fixture. In this way, when one of the operating lamps was removed, the phantom tube was inserted and the remaining lamp could operate with a reasonable degree of efficiency. These phantom tubes, in one embodiment, employ a capacitor connected between the sockets from which a lamp was removed, such as the type described in U.S. Pat. No. 3,956,665 to Westphal. In other cases, the phantom tube relied upon a nonreactive lamp circuit, as for example, as described in U.S. Pat. No. 4,053,811 to Abernathy.

In each case, the phantom tube while effective in permitting reduction in power, was oftentimes undesirable due to the fact that it drew attention to the fact that one of the operating lamps was removed. Thus, it always appeared as though one of the lamps in a two lamp fixture was burned out and not replaced. In addition, the removal of one or more of the lumen producing lamps oftentimes created uneven light distribution and was therefore ineffective for the desired purpose. In addition to the above, unless the capacitor or the power factor compensating element was not accurately established for a particular circuit, there was a resultant power factor loss.

In addition to the foregoing, the lamp substitute devices e.g. the so-called phantom tube, was ineffective, in some cases, due to the fact that it was not easy or convenient to repair the phantom tube, particularly in the event of a capacitor burn-out. Moreover, inasmuch as these tubes were constructed primarily of glass or lightweight plastic material, they had to be carefully packaged in order to reduce the incident of breakage or damage during shipment and transportation. This resulted in an increase in the cost of the shipment and hence the cost of the phantom tubes. Notwithstanding, even with careful packaging, there was also a substantial rate of breakage and damage as a result of shipment and for that matter, improper handling during storage.

There has been at least one attempt to reduce power consumption and also lumen output in a circuit configuration which employed two or more fluorescent lamps. This one proposal has been taught in U.S. Pat. No. 4,135,115 to Abernathy et al. However, in the Abernathy et al Patent, the device which is utilized is rather complex and includes a step-up transformer, as well as a plurality of capacitors and a resistive element. This device is constructed so as to at least step-up the voltage for a short period of time in order to achieve starting of the lamp. Moreover, this particular device is only effective for use with the so-called "rapid-start" circuit and is not effective for use in other circuit configurations, as for example, the so-called "instant-start" circuit, etc.

In addition to the above, the device in the Abernathy, et al Patent is also relatively ineffective in that it must be physically connected in the circuit by disconnecting one or more of the electrical lines with respect to the ballast. Thus, it was necessary to employ someone skilled in electrical circuit work, such as a licensed electrician to disconnect the power, break one or more of the lines and connect the device taught in the Abernathy et al Patent into the circuit arrangement. This resulted in down time, a substantial increase in installation costs and further, a very substantial increase in cost of the device itself.

The present invention obviates these and other problems in the provision of the very simple load limiting control means which is cable of being inserted in the circuit without the necessary disconnection of any of the electrical lines. Moreover, the device of the present invention is quite simple in its construction and permits a reduction of lumen output with a corresponding reduction of power consumption and which is highly efficient.

OBJECTS OF THE INVENTION

It is, therefore, a primary object of the present invention to provide a means for limiting the power consumption and the lumen output of a phosphor excitable lamp which is connected to a source of power for operation of the same without any appreciable loss in efficiency of operation of either the lamp or the power source, by utilization of a load limiting control means interposed between the lamp and the source of power in a series arrangement.

It is another object of the present invention to provide means of the type stated which utilizes at least a capacitor having a value selected so that the lumen output is reduced and the power consumption is reduced by without substantially changing the voltage which is applied to the lamp.

It is further object of the present invention to provide a means of the type stated which is capable of being electrically connected and disconnected without connecting or disconnecting anything other than the lamp.

It is also an object of the present invention to provide a device with utilizes a capacitive element and/or inductive element for limiting the power consumption and correspondingly limiting the lumen output of a phosphor excitable lamp which is normally connected between a pair of sockets in a fixture and where the capacitive element and/or inductive element can be interposed between an end terminal of the lamp and a conductive terminal in the socket of the fixture.

It is still another object of the present invention to provide a method of limiting power consumption and lumen output of a phosphor excitable lamp connected to a source of power without any appreciable loss of efficiency by electrically connecting a capacitive means or an inductive means or combination thereof to one terminal of the phosphor excitable lamp and electrically interposing this means between the lamp and the source of power in order to reduce the power consumption and the lumen output and yet maintain a high degree of efficiency of operation of the lamp and the source of power.

It is yet a further object of the present invention to provide a method of reducing power consumption and correspondingly reducing lumen output of a lamp by inserting a device which has a capacitive value and/or an inductive value selected to perform these functions without substantially changing the voltage which is normally applied to the lamp and which does not require physical connection and disconnection of any electrical components, other than the lamp.

With the above and other objects in view, my invention resides in the novel features of form, construction, arrangement and combination of parts presently described and pointed out in the claims.

BRIEF SUMMARY OF THE DISCLOSURE

A means for limiting power consumption and lumen output of a phosphor excitable lamp connected to a source of power for operation of the same and which means permits such reduction without appreciable loss in efficiency of operation of either the lamp or the source of power.

The term "phosphor excitable" in connection with a light producing, electrically operable lamp, is deemed to include those lamps which utilize an excitable phosphor in order to start or maintain operation of the same and include for example, the fluorescent lamp, the so-called "cathode discharge" lamp and the electroluminescent lamp, etc. Inasmuch as these lamps are well known in the art, they are not described in any substantial detail herein.

The means for reducing the power consumption generally is a load limiting corrective means which may adopt the form of a circuit of a capacitive means or a circuit of a combination capacitive and inductive means, or both, and where the inductive means, or the capacitive means, or both, is electrically connectable to one terminal of the phosphor excitable lamp and is effectively electrically interposed between the lamp and the source of power in a series connection. This capacitive means is selected with a capacitive value so that the lumen output is substantially reduced but yet is substantially uniform at the reduced level. Moreover, the power consumption is substantially reduced without changing the voltage to the lamp and without appreciable effects on the efficiency of operation of the lamp or the source of power.

The means of the invention is highly effective in that it permits interposition of the load corrective or compensating means without electrically connecting or disconnecting any wire or other component, other than the lamp itself. Moreover, the invention is effective in that the means consists essentially of the conductors associated with a capacitor and/or inductor. Thus, it is not necessary to employ any complex circuitry such as complex transformers, integrated circuit chips or the like.

In one preferred embodiment of the invention, the capacitive means has a capacitive value of from about two microfarads to about fourteen microfarads. In a more preferred embodiment of the invention, the capacitive means has a capacitive value of from about eight microfarads to about twelve microfarads, depending on several factors, including the type of ballast which is used. In like manner, the inductive means, when employed in combination with the capacitive means has an inductive value of from about three mili-henreys to about four mili-henreys at 1000 cycles.

The load limiting control means of the invention is primarily effective in limiting the power consumption and lumen output of a plurality of phosphor excitable lamps, and preferably, a plurality of such lamps in a series circuit arrangement, that is where the lamps are in a series arrangement with respect to each other and with respect to a source of power for operation of the lamps. In this case, as for example, where two such lamps are connected in a series arrangement, it is only necessary to use the load limiting control means with one of the lamps. This will cause a reduction of lumen output and a corresponding reduction of power consumption with respect to both lamps in the fixture.

Typically, the fixtures which retain phosphor excitable lamps, such as fluorescent lamps, are provided with pairs of spaced apart sockets which receive the ends of the lamp. Particularly, the sockets are provided with conductive terminals electrically connected to the circuit which provides power, as for example, the ballast. Moreover, the lamps are also provided with one or more terminals on each of the ends. The number of terminals in many cases is dependent upon the type of operation and the circuit arrangement used in the ballast. The invention is effective in that at least one end of the lamp is connectable to the load limiting control means which is, in turn, connectable to the conductive terminal in the socket. In this way, it is not necessary to break any electrical lines or the like. Moreover, it is important to note that a different electrical circuit path is established through the load limiting control means as opposed to a circuit path from the end terminal of the lamp directly to the conductive terminal in the socket. It is this different electrical circuit path which permits the high degree of efficiency in operation with the substantially reduced lumen output and power consumption.

In one effective embodiment of the invention, the load limiting control means exists in the form of a device having at least a relatively thin wafer which is capable of being interposed between the end terminal on the lamp and the conductive terminal in the socket. This device is generally comprised of a first conductive element which is adapted to be engaged by and establish electrical connection with at least one end terminal of the lamp. The device also includes a second conductive element which is adapted to engage and establish an electrical connection with a conductive terminal of the socket. An electrically non-conductive element is located between the two conductive elements. Moreover, the capacitor and/or inductor is electrically connected to the two conductive elements such that the circuit path is not established directly through the end terminals of the lamp and the conductive terminal of the socket, but rather through the load limiting control device itself.

In another embodiment, with respect to the device, the aforesaid conductive elements and the non-conductive element are suitably located within a housing and preferably an electrically non-conductive housing. In this case, a recess is formed in the housing to receive the end terminal, such as the pin, on the lamp. Moreover, a prong is formed on the other side of the housing and is connected to the first of the electrically conductive elements for insertion into the socket. This prong will essentially have the same size as the end terminal or pin on the lamp.

It is possible to insert the device of the invention between one end of the lamp and the socket inasmuch as the fixture is generally constructed so that one of the sockets is provided with a spring means to provide some leeway and space for the lamp to be shifted back and forth for purpose of removal and reinsertion.

One of the preferred embodiments of the present invention does not require utilization of the spring means to provide some space for insertion of the load limiting control means. In this embodiment of the invention, the load limiting control means is constructed in the form of a housing so that it is electrically connectable to one of the terminals of a conventional phosphor excitable lamp, and to a socket which received that lamp, so as to be effectively electrically interposed between the lamp and the source of power in a series connection. In this case, the control device is constructed so that it has a first section capable of fitting with respect to the socket. More specifically, it is provided with at least one electrically conductive element, such as a prong, which is inserted into an electrically conductive recess in the socket. In addition, the device is provided with a second section offset from the first section and adapted to receive the end of the lamp, as for example, an end terminal of the lamp. This end terminal is received in an electrically conductive recess formed in the second section of the device. In this embodiment of the invention, the lamp may be offset from its original connection in the socket by a slight distance.

This latter embodiment of the invention has been found to be very effective in that it does not require any snug fitting engagement and moreover, can be manufactured with the desired tolerance in each, and which lends to convenience of installation of the lamp.

The device of present invention is capable of operation with the so-called "instant start" light fixture using only the capacitor. The device of the invention is operable with the so-called rapid start fixture in which a capacitor-inductor circuit is employed. In each case, the means for creating the reduction of power consumption and lumen output relies primarily on the capacitive means. In the first case, the capacitive means is deemed to include that wafer and the electrical elements therein as well as the non-conductive element therein, inasmuch as the electrically conductive elements and non-conductive element only serve to establish a path through the capacitor. In other words, there is no electrically effective element other than the capacitor itself. In the second case, the capacitor may be a primary element but other elements may be present, e.g. an inductor and all serve as the load limiting control device.

This invention possesses many other advantages and has other purposes which may be made more clearly apparent from a consideration of the forms in which it may be embodied. These forms are shown in the drawings forming and accompanying part of the present specification. They will now be described in detail for the purposes of illustrating the general principals of the invention, but it is to be understood that such detailed descriptions are not to be taken in a limiting sense.

BRIEF DESCRIPTION OF THE DRAWINGS

Figure 1:
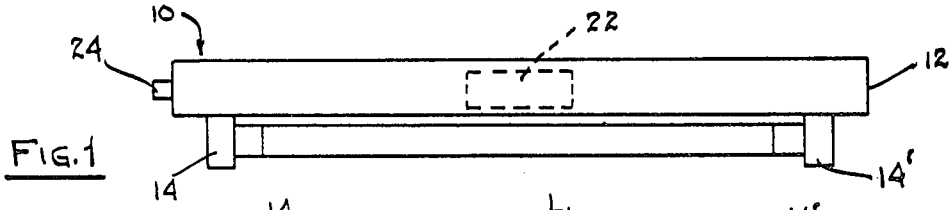
Figure 2:
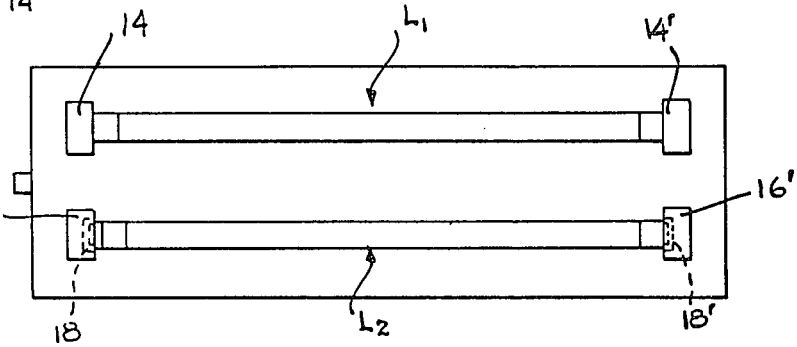
Figure 3:
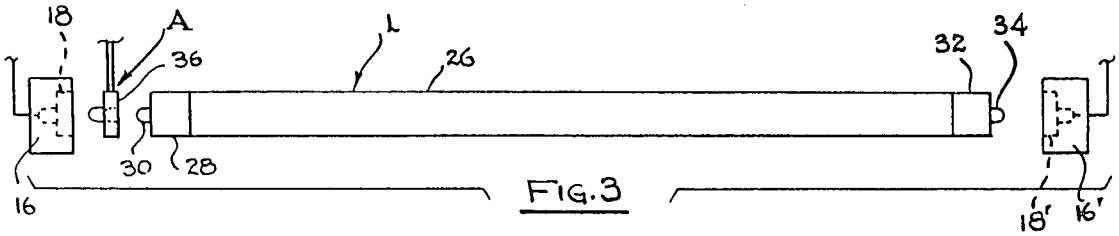
Figure 4:
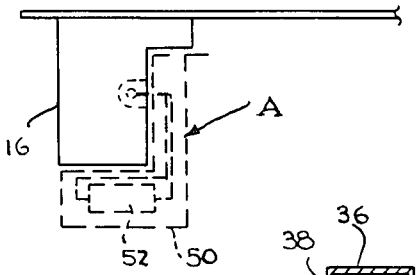
Figure 5:
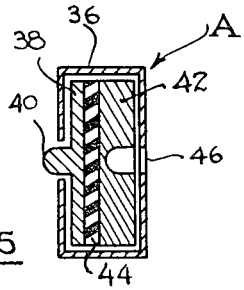
Figure 7:
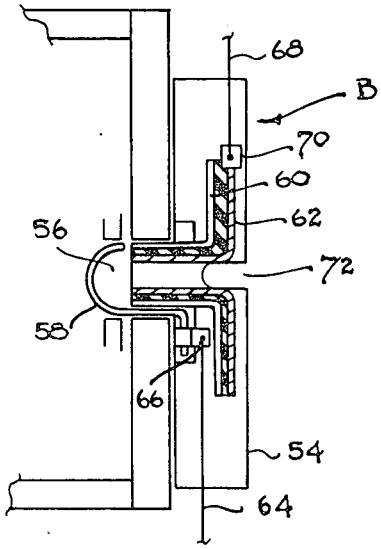
Figure 6:
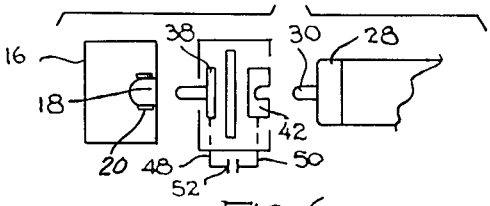
Figure 8:
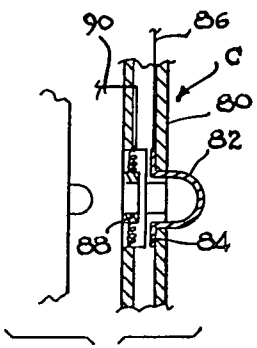
Figure 17:
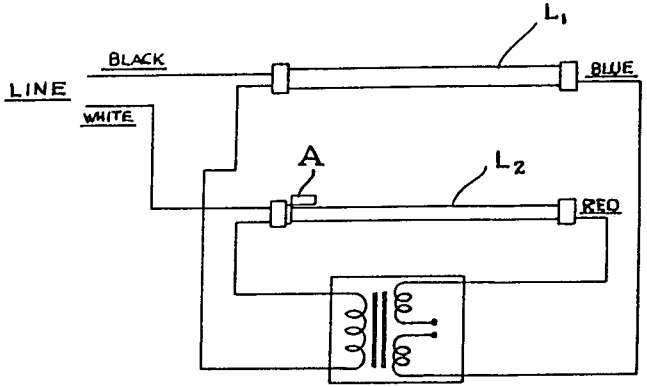
Figure 18:
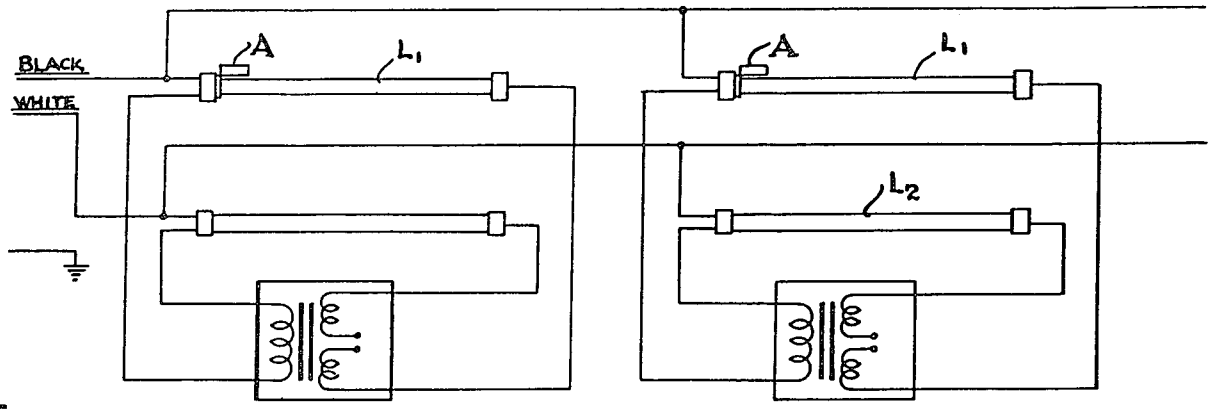
Figure 9:
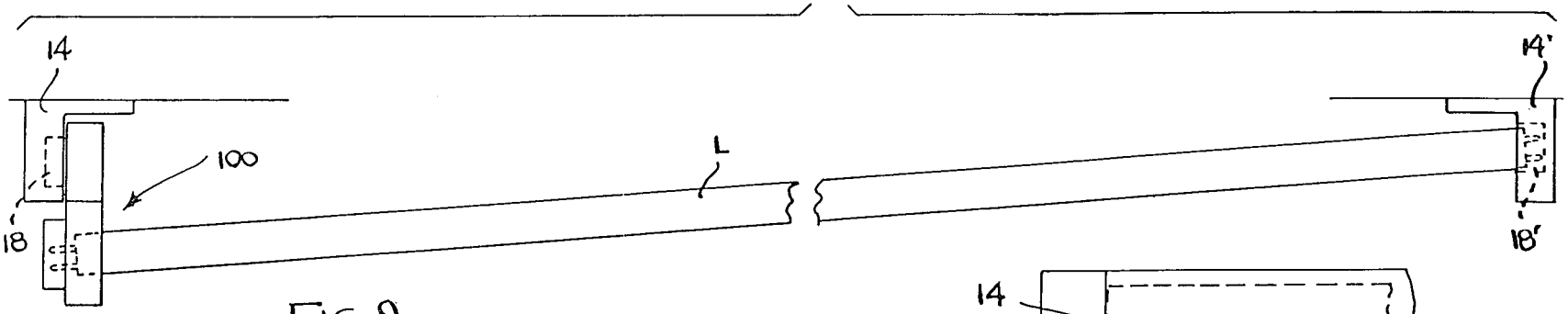
Figure 11:
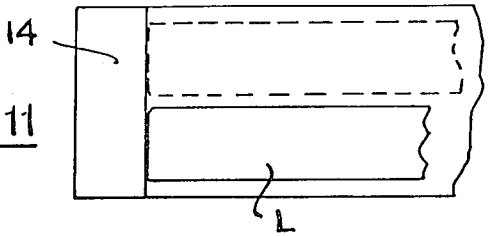
Figure 10:
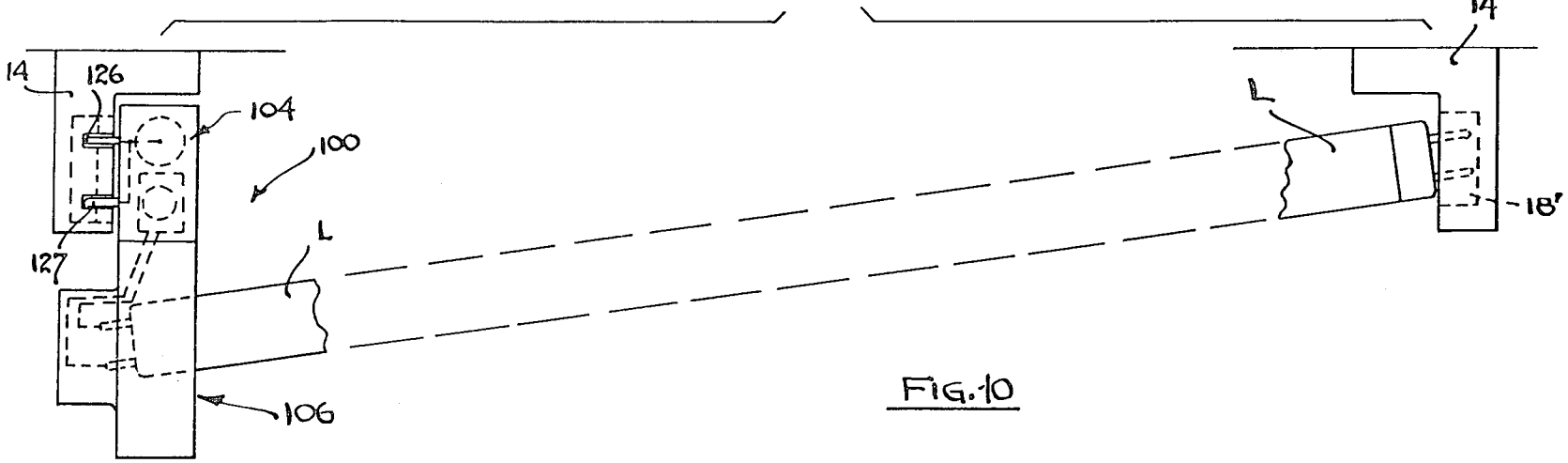
Figure 14:
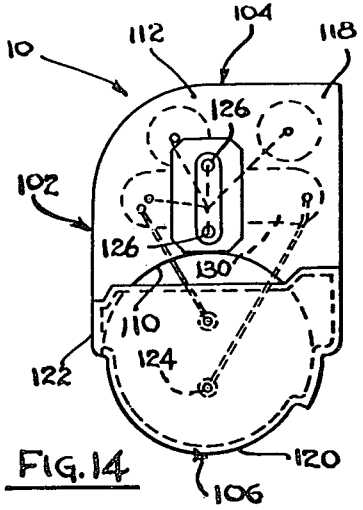
Figure 13:
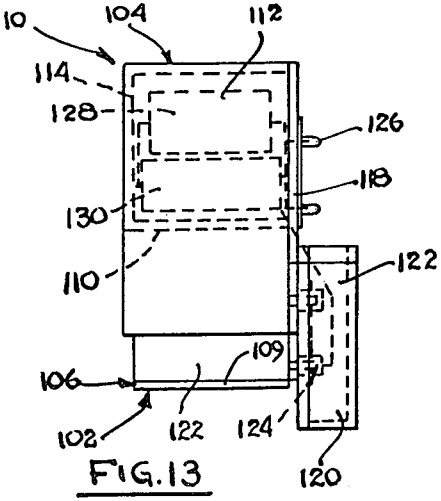
Figure 15:
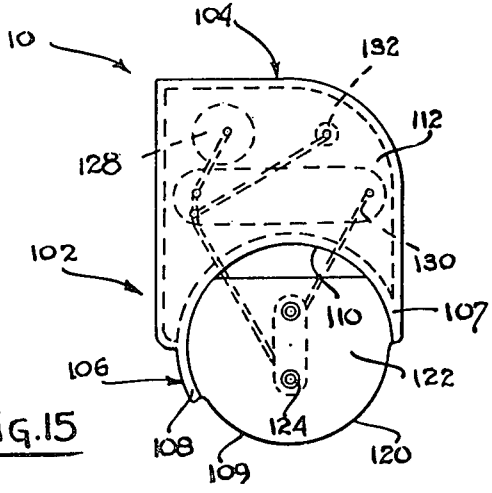
Figure 12:
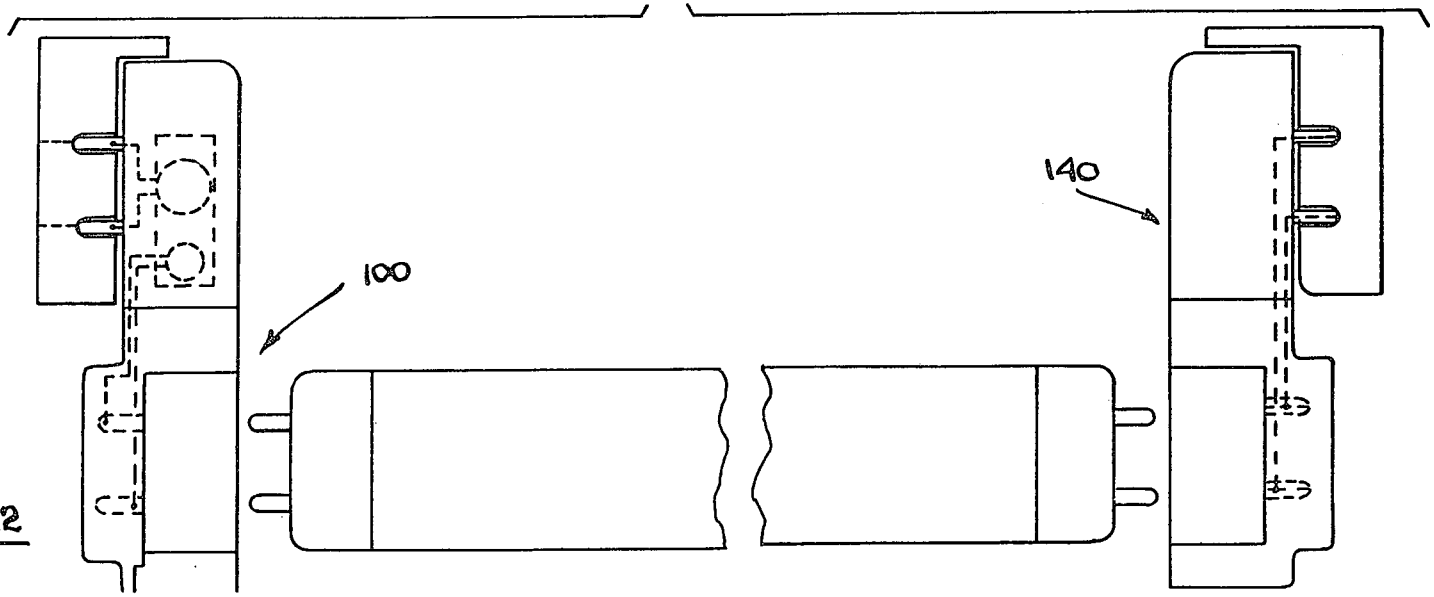
Figure 16:
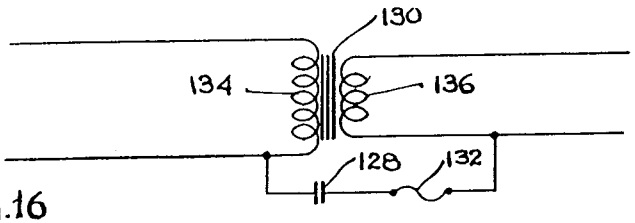
Figure 19:
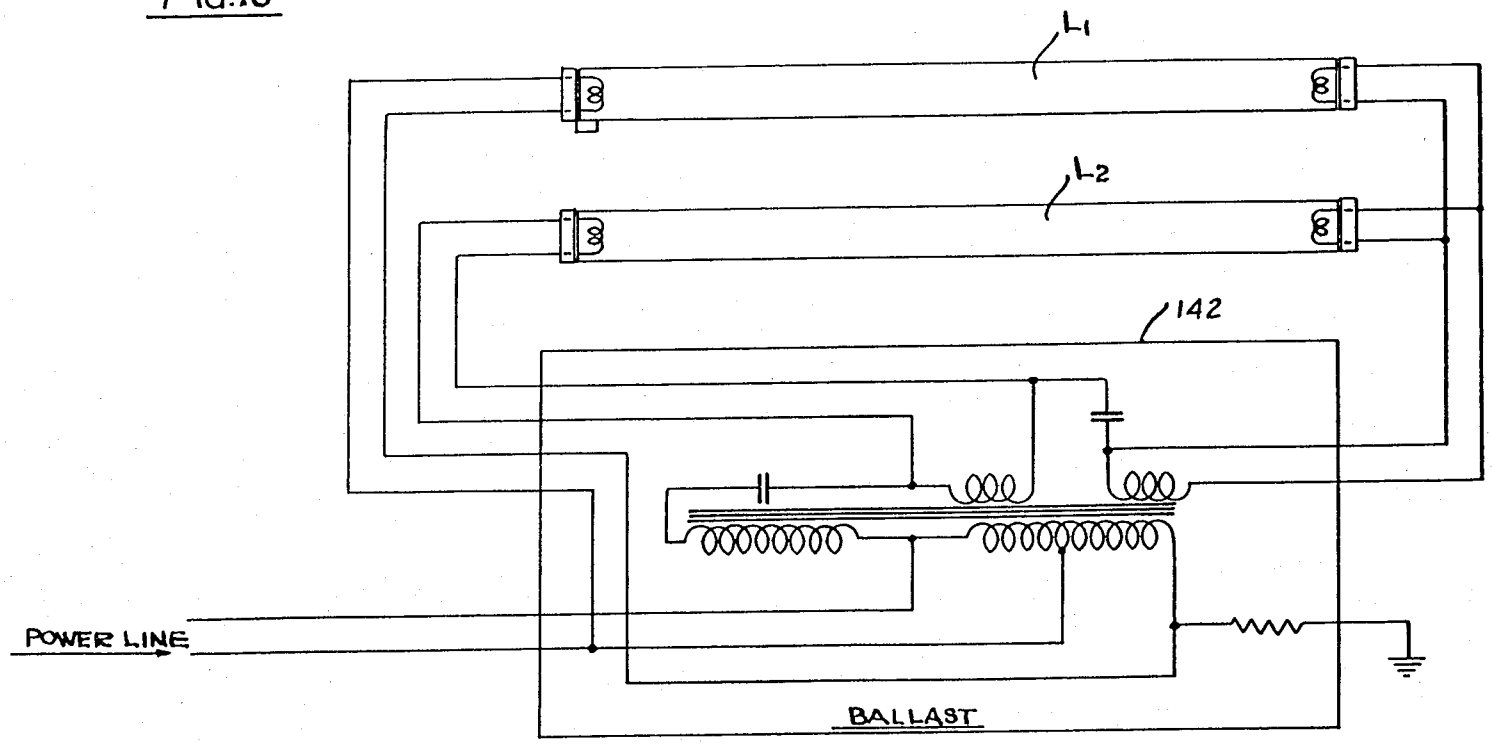

Having thus described the invention in general terms, reference will now be made to the accompanying drawings in which:

FIG. 1 is a side elevational view of a conventional light fixture with phosphor excitable lamps mounted in the sockets thereof;

FIG. 2 is a bottom plan view of the fixture of FIG. 1 and showing a pair of phosphor excitable lamps mounted in the sockets thereof and with a load limiting control means of the present invention inserted between one of the ends of the lamps and one socket thereof;

FIG. 3 is an exploded side elevational view, partially in dotted lines, showing the load limiting control means in relation to one end of a conventional fluorescent lamp and with respect to a pair of spaced apart sockets;

FIG. 4 is a side elevational view, partially in phantom lines, and showing one form of load limiting control device used in the present invention;

FIG. 5 is a somewhat schematic vertical sectional view showing the components forming part of the device of the present invention;

FIG. 6 is an exploded side elevational view, somewhat schematic in nature, and showing the interposition of the device of FIG. 5 with respect to an end of a lamp and a socket of the fixture;

FIG. 7 is a vertical sectional view and showing a more detailed construction of one embodiment of a load limiting control device constructed and in accordance with and embodying the present invention;

FIG. 8 is a vertical sectional view of a modified form of load limiting control device of the present invention;

FIG. 9 is a side elevational view showing a phosphor excitable lamp inserted in a fixture with one of the load limiting control devices of the present invention;

FIG. 10 is a schematic side elevational view, partially broken away, of FIG. 9, showing in more detail, the portions of the load limiting control device and the means in which the phosphor excitable lamp is connected;

FIG. 11 is a bottom plan view, partially broken away and showing an alternate arrangement for mounting a lamp in a fixture;

FIG. 12 is side elevational view, partially broken away, and in section, and showing the details of construction when using a pair of the load limiting control devices of the present invention;

FIG. 13 is a side elevational view of a preferred embodiment of a load limiting control device of the present invention, adapted for use with the rapid start circuit arrangement;

FIG. 14 is a schematic end elevational view of the embodiment of the load limiting control device of FIG. 13 and used with the so-called "rapid start" circuit arrangement;

FIG. 15 is an opposite end elevational view of the device of FIGS. 13 and 14;

FIG. 16 is a schematic electrical circuit arrangement showing the electrical comnponents in one embodiment of the load limiting control device of the present invention;

FIG. 17 is a schematic electrical circuit view showing the use of a load limiting device of the present invention with one of the light emitting lamps in a two lamp fixture, in a modified form of "instant start" circuit arrangement;

FIG. 18 is a schematic electrical circuit view, similar to FIG. 16, and showing the use of a load limiting control device of the present invention used with one lamp in each of a pair of series connected fixtures in an "instant start" circuit arrangement; and FIG. 19 is a schematic electrical circuit view, somewhat similar to FIG. 18, but showing the use of the load limiting control device of the present invention used with one lamp in a pair of series connected lamps in a "rapid start" circuit arrangement.

DETAILED DESCRIPTION OF PREFERRED EMBODIMENTS

Referring now in more detail and by reference characters to the drawings which illustrated practical embodiments of the present invention, FIGS. 1 and 2 show a conventional fixture 10 of the type which holds and provides for energization and resultant lumen output from phosphor excitable lamps, e.g. fluorescent lamps.

The fixture is generally provided with an outer housing 12 having a generally rectangular shape, as illustrated. Moreover, depending from a bottom wall of the housing 12 are two pairs of connector plates 14 and 14' and 16 and 16', as more fully illustrated in FIG. 2 of the drawings. Each of the connector plates are provided with sockets of the type normally found in conventional fluorescent light fixtures. Thus, for example, the connector plates 16 and 16' are provided with sockets 18 and 18' respectively. Moreover, these sockets are typically bayonet type sockets and include the conductors therein for creating an electrical circuit through the phosphor excitable lamp, such as a lamp L.

FIG. 6 schematically illustrates a pair of conductors 20 in the socket 18 of the connector plate 16. Moreover, and in this case, the electrical conductors 20 which are often referred to as "conductive terminals", are connected in spaced apart relationship. In this way, a single pin tube may be used to establish contact between the two conductive terminals 20.

Also normally included within the housing, although it may be located elsewhere, is a conventional ballast 22. The ballast is electrically connected to the sockets and particularly the conductive terminals 20 in the sockets 18 and 18'.

Various circuit arrangements may be employed in these conventional fluorescent fixtures. For example, the circuit arrangement may be that of the so-called "instant start" circuit arrangement or the so-called "rapid start" circuit arrangement. The embodiment illustrated in FIGS. 1–8 is generally designed for, although not exclusively designed for, the instant start circuit and the embodiment in FIGS. 9–14, is generally designed for the rapid start arrangement. In any event, the fixture is generally designed so that two or more phosphor excitable lamps, such as the lamps designated as $L_1$ and $L_2$ in FIG. 2, are connected in a series relationship with respect to each other or with respect to the ballast 22 or other power source. In like manner, the fixture may be provided with a fuse cap 24 for retaining a fuse in the electrical circuit including the ballast 22.

The typical fluorescent lamp is only one embodiment of a phosphor excitable lamp as aforesaid, and is also a gaseous discharge lamp. The typical fluorescent lamp comprises a tube 26, which is shown as having a straight glass tube, although the tube often adopts other shapes, as for example, a circular shape, or the like. One end of the tube is provided with a base or end cap 28 having one or more electrical terminals 30 at each end, often called "end terminals". A similar end cap 32 having one or more terminals 34 (one as shown) is located at the opposite end of the tube 26.

These terminals, which are also often referred to as "base pins", are connected to lead-in wires located internally within the tube, and the lead-in wires are located in a so-called "stem press" constructed of a material to assure the same coefficient of expansion as the glass tube. The lead-in wires are connected to a cathode which may be a hot cathode which is designed to ignite a gas in the tube as hereinafter described. The hot cathode is coated with an emissive material which emits electrons and is usually made of a coil, e.g., a simple coil of tungsten wire. In many commercial embodiments, a pair of similar hot cathodes and related structure would be included at each end of the glass tube.

The inside of the bulb or tube is provided with a phosphor coating which transforms ultraviolet radiation into the visible light. The color of the light often depends on the composition of the phosphor. A minute amount of mercury is also located in the lamp to furnish the mercury vapor for purposes of ignition. In addition, an inert gas, such as argon, krypton, and the like, may be used. The coating on the hot cathode is generally formed of an emissive material such as barium, strontium, calcium oxide, or the like, and which emits electrons when heated to an operating temperature of about 950 degrees C. After the cathode has been heated to the proper temperature, thermionic emission will occur. The emitted electrons, upon collision, will release ultraviolet radiation which is converted into visible light by the phosphors.

The conventional electroluminescent lamp is comprised of a plastic plate which is translucent and preferably transparent in its construction. Applied to one surface of this plate is a phosphor coating and disposed against the phosphor coating is a metal sheet such as an aluminum sheet. Conductors are attached to the phosphor coating and the metal sheet. These conductors are adapted for connection to a suitable source of current through a ballast, and in the case of the present invention, would be connected to inputs of the generator. The electroluminescent lamp operates on essentially the same principle as the gaseous discharge lamp. However, in this case, the phosphors are not located in a tube or bulb. The electroluminescent lamp operates with a very high frequency creating a capacitive effect across the phosphor coating and the metal sheet with the phosphors converting the ultraviolet radiation into visible light radiation.

FIG. 3 is a somewhat schematic representation of the alteration occuring in the circuit arrangement when a load limiting control device of the recent invention is used with one or more lamps. In this respect, it should be observed that the device is always used in a series connection with a single lamp with respect to a power source. In the event where one or more lamps are connected with respect to a power source, such as a ballast, and particularly in a series arrangement of the lamps, the load limiting control device is also always used in a series circuit connection.

The term "power source" is also deemed to include that source of electrical power which may be the line power such as a 110 volt AC electrical circuit, or otherwise, the ballast itself. Thus, in some cases, the input power is introduced directly into the ballast, as in the so-called "instant start" arrangement. Nevertheless, the ballast in this case is also deemed to be the power source.

In the arrangement in FIG. 3, it can be observed that a conventional fluorescent lamp L is located between a pair of sockets, as for example, the sockets 16 and 16'. At the left-hand end of the lamp L, a capacitive device A of the present invention is inserted between the lamp and the conductive terminal in the lamp socket. In the embodiment of the device illustrated in FIGS. 1–7, the device is often referred to as a "capacitive device" inasmuch as the primary electrical control element is capacitive in nature. In this case, it can be observed that the device A includes a disc like housing 36 which is capable of being fitted within the socket 18 of the connector plate 16. Moreover, the end pin or end terminal of the lamp is adapted to be inserted into the housing 36, in the manner as hereinafter described.

The load limiting or capacitive device A of the invention is more fully illustrated in FIGS. 5 and 6 of the drawings. In this case, the device A includes the outer housing 36. Moreover, included within the outer housing 36 is a first electrically conductive element 38 which is provided with a projection 40 extending beyond the housing. In this case, the projection 40 has essentially the same size and overall shape as the terminal pin 30 of the lamp. In addition, the housing 36 is sized to extend into the socket or at least a portion of the socket 18, as aforesaid. Thus, when the housing is so inserted, the projection 40 will contact the conductors 20 within the socket, much in the same manner as the end pin 30 on the lamp L. It should also be understood, in connection with the present invention, that when bi-pin or double-pin lamps are used, the device A would also be provided with a similar pin arrangement. This latter double-pin arrangement is usually employed with the rapid start circuit arrangement. The device A also includes a second electrically conductive element 42 and which is spaced from and insulated from the conductive element 38 by an electrically non-conductive element 44. The housing is also provided on its right-hand end, reference being made to FIGS. 5 and 6, with a recess 46 which opens into the conductive element 42. Thus, when the load limiting control device A of the invention is used, the end terminal or pin 30 on the lamp L will extend through the recess 46 and contact the conductive plate 42.

By reference to FIG. 6, it can be observed that the housing 36 is preferably in the form of a relatively thin disc-like member. Consequently, in many cases, it is not easy to include the capacitor directly in the housing. In this case, where the capacitor cannot be included in the housing, a pair of leads 48 and 50 are connected to the respective electrically conductive elements 38 and 42 and which are in turn, connected to a capacitor 52. The capacitor itself may also be enclosed within a suitable housing, in the manner as illustrated in FIG. 4, such that a complete individual housing is connected to one socket as for example, a recess to receive the terminal pin or pins at the end of the lamp.

The load limiting control device is also designed and sized so that it is capable of being disposed within a socket of the connector plate. The pin on the end of the lamp would then fit within a recess on the capacitive device. However, it should be understood that the capacitive device could be designed so that it fits over the end of the pin on the tube, with the prong of the device extending into contact with the conductive elements in the socket. One such embodiment where the device fits over the end of the pin is hereinafter described in detail.

In the embodiment of the device as illustrated, it can be observed that the housing 36 is preferably formed of an electrically non-conductive material. In this way, if a capacitor is still charged when one attempts to remove the capacitive device, there will be no potential damage or injury. In this respect, the housing includes a portion which extends into the recess 46 so as to electrically isolate the same. Consequently, it would be difficult for one to stick his or her finger into this recess. Even if the user of the device attempted to contact the projection 40 he or she would not be able to contact the conductive element 42 and thus, no electrical short could occur, even though the capacitor 52 had some residual charge.

It can be observed particularly from FIG. 6, that when any of the load limiting control devices of the invention is used, an entirely different circuit path is established. In this case, as opposed to a circuit path being created from the terminal, e.g. the terminal pin 30 on the lamp directly to the conductive terminal 20 in the socket, the path is created through the terminal pin 30, the conductive element 42, the capacitor 52, the conductive element 38, projection 40 and then the conductive terminal 20.

The capacitor has a capacitive value established so as to minimize any power factor loss or load control loss and to maintain a high degree of efficiency of operation. It has been found in connection with the illustrated device, that the capacitive value may range from about eight microfarads to about fourteen microfarads. In a more preferred embodiment, the capacitive value of the capacitor used should range from about two microfarads to about twelve microfarads. Generally the capacitive valve for a device used in an instant start circuit should range from about two microfarads to about six microfarads and pereferably from about three microfarads to about three and one-fourth microfarads. In the rapid start circuit, as hereinafter described in more detail, the capacitive valve should normally range from about four to about twelve microfarads and preferably from about ten to about twelve microfarads for the HO and HVO lamp arrangements.

It has been found that on the average, electrical power reduction is about 30% in a two lamp circuit arrangement and the illumination is reduced about 27%. Consequently, there does not appear to be any significant loss in percentage of illumination with respect to the percentage in power reduction. In fact, there has been found to be an overall unexpected efficiency in terms of illumination with respect to power reduction. Equally important is the fact that the ballast and the lamps and the life of these components are not damaged. Contrarywise, the life of the lamp and the ballast itself has increased substantially by virtue of the reduction of power used in operating both.

FIG. 7 illustrates one preferred embodiment of a device B which may be used. In this case, the device B generally comprises an outer housing 54 which is preferably formed of a non-conductive material and which is provided with a central opening 56 along one of the flat walls thereof, as the left-hand flat wall, in the manner as illustrated in FIG. 7. Located within the housing 54 is an electrically conductive strip 58 which is curved and shaped so as to form a shape similar to that of the projection 40. Moreover, the shape of the strip 58 which forms this projection is similar to that of a pin, such as the terminal pin 30 on the lamp. By reference to FIG. 7, it can be observed that the strip 58 does not extend all the way into the housing but is spaced apart from a similar strip 60 which is secured within the housing 54 and extends outwardly therefrom to aid in the formation of a shape equivalent to that of the projection. Also located within the housing 54 is a second conductive strip 62. The conductive strip 58 is connected to a first electrically conductive wire 64 by means of a clamp 66. A second electrically conductive wire 68 is connected to the strip 62 by means of a clamp 70 also in the manner as illustrated in FIG. 7. These two electrically conductive wires 64 and 68 would be suitably connected to a capacitor, such as the capacitor 52.

The right-hand end of the housing 54 is provided with a recess 72 having a size and shape similar to the terminal pin 30 on any one of the fluorescent lamps. In this case, the recess is at least partially open so that a terminal pin on the lamp will contact the conductive strip 62 located adjacent to the recess.

Also located within the housing 54 is an insulator which surrounds the conductive strip 62 and electrically insulates the same from the conductive strip 60 or the conductive strip 58 which forms the projection. In this way, the equivalent structure of that illustrated in FIGS. 5 and 6 is achieved. This embodiment of the capacitive device has been found to be highly effective and is easy to manufacture and moreover, is relatively easy to repair.

FIG. 8 illustrates a device C which is designed to fit over the end of a pin on a fluorescent tube or similar phosphor excitable lamp and have a projection thereof extend into the socket of the lamp. In other words, this device is capable of fitting over the end of the tube, e.g., on the pin as opposed to being inserted into the socket itself. The device C generally comprises an outer housing 80 which is preferably formed of an electrically non-conductive material, such as a plastic, or the like. Extending outwardly from one side of the housing 80 is a metallic prong 82 which is of a size similar to that of a pin on the end of a fluorescent lamp. Thus, this projection 82 is sized to extend within the socket which normally receives a conventional fluorescent lamp.

The projection 82 is provided with an outwardly flaring flange 84 serving as a terminal within the housing 80. An electrically conductive wire 86 is connected to this flange 84. In addition, a cylindrically shaped ring 88 is also located on the opposite side of the housing with respect to the projection 82 and is effectively electrically insulated by the housing from the flange 84. The ring 88 is also electrically connected to a conductive wire 90. Moreover, the conductors 86 and 90 are connected to a capacitor of the type previously described.

FIG. 17 illustrates a circuit arrangement and particularly the so-called "instant start" circuit arrangement in which a pair of fluorescent lamps $L_1$ and $L_2$ are connected in series. In this case, a load limiting control device, e.g. a capacitive device, has been used with the lamp $L_2$. It can be observed that the capacitive device of the invention has been inserted at the left-hand end socket although it could be located on the right-hand end socket.

Typically, many of the fluorescent lamp fixtures usually include within the fixture, a black colored lead and a white colored lead, the black colored lead designating the so-called "ground" terminal as in a conventional 120 volt electrical power line. Moreover, conventional fixtures often include a blue colored electrically conductive line and a red colored electrically conductive line. These latter two electrical lines or wires are generally connected to one of the coils in the transformer of the ballast. In the preferred embodiment of the invention, the capacitive device is preferably used at that socket which includes either the blue conductor or the red conductor and preferably that socket which has the blue conductor connected thereto.

FIG. 18 illustrates a circuit arrangement very similar to FIG. 17 although two such fixtures using the instant start circuit arrangement are connected in series. Here again, the capacitive device is shown as being located in conjunction with the lamp $L_1$ in one of the fixtures and a similar lamp $L_1$ in the next adjacent fixture. No capacitive devices are used in connection with the lamps $L_2$ in either of these fixtures. In accordance with the above, it can be observed that the circuit path is changed in both the rapid start and the instant start circuit arrangements. Moreover, the circuit path is changed by the mere insertion of the capacitive device in the tandum circuit arrangements as illustrated in FIG. 18.

FIGS. 9–16 and 19 more fully illustrate an embodiment of the invention used with the so-called "rapid-start" circuit arrangement. In this case, a load limiting control device designated by reference numeral 100 and forming this embodiment of the invention is used to connect a typical conventional rapid-start lamp $L_1$ to the sockets 18 and 18', respectively, in connector plates 14 and 14' which form part of a conventional fluorescent lamp fixture. This fixture is similar to the type used for retaining the instant-start lamps, as illustrated in connection with the embodiment of the invention shown in FIGS. 1–8. However, in the instant-start lamp arrangement, typically one pin is centrally located on each of the opposite ends of the lamp and the fixture is adapted to have one pin receiving aperture on each of the opposite sides to receive the associated pins. On the other hand, in the rapid-start circuit arrangement, the lamps are typically provided with a pair of spaced apart conductive pins or terminals on each of the opposite ends of the lamp. In like manner, the sockets forming part of the fixture are each provided with a pair of pin receiving apertures adapted and located to receive the pairs of pins on each of the opposite ends of the lamp.

In the embodiment of the invention as illustrated in FIGS. 9 and 10, it can be observed that one end of the lamp (the right-hand end, as illustrated) is normally inserted into the socket 18' of the connector plate 14'. However, the opposite, or left-hand end of the lamp L as shown in FIGS. 9 and 10, is displaced downwardly from the socket 18 in the connector plate 14 in the final connected position. Rather, the left-hand end of the lamp L is connected to a first portion of the load limiting control device 100 and which also has a second portion connected to the socket 18 and the connector plate 14.

The load limiting control device 100 is more fully illustrated in FIGS. 9 and 10 and generally comprises a main outer housing 102 preferably formed of the upper section which is designated by reference numeral 104 and the lower section which is designated by reference numeral 106.

The outer housing 102 is preferably formed of a molded plastic material as, for example, polyethylene, polystyrene, polybutadiene, various co-polymers thereof, or the like. In essence, it is important that the housing be constructed of a material which is effectively electrically inert. In this respect, various reinforced plastic composite materials may also be employed in construction of the housing 102 and the associated components.

The outer housing 102 is preferably formed with the upper section 104 and the lower section 106 in such manner that the upper section 104 is capable of being inserted into a socket in the fixture and the lower section 106 is capable of receiving one end of the lamp L. Referring to FIGS. 9 and 10, as well as FIGS. 13–15, it can be observed that the upper section 104 is actually the upper section when fitted within the socket of a fixture. The conventional fluorescent lamp is normally inserted into a socket and rotated approximately 90 degrees to be retained therein. Upon removal of the lamp, it is first rotated approximately 90 degrees in the opposite direction. In normal use, and before actual connection to a lamp and to a fixture, the lower section actually is displaced to one side about 90 degrees much in the manner as the lamp. When rotated about 90 degrees after being inserted in the fixture socket, the lower section for purposes of installation, shifts from a position where it is aligned with the upper section (in a horizontal plane) to a position where it is disposed beneath the upper section.

FIG. 11 illustrates an embodiment of the invention where one end of the tube is fitted within one socket of the fixture and the opposite end of the tube is fitted within the load limiting control device. However, when in the final mounted position, the second end is offset laterally from the other end or first mentioned end of the tube as opposed to being disposed below the first mentioned end of the tube as illustrated and described in connection with the embodiments of the invention illustrated in FIGS. 9, 10 and 12–15. The lateral offset is preferred where tollerance space is not sufficient for two or more lamps in certain fixtures. Otherwise, the vertically disposed arrangement as illustrated in FIGS. 9, 10 and 12–15 can be employed. The remaining details of operation are essentially the same.

Again referring to FIGS. 11 and 13–16, it can be observed that the lower section 106 is formed by a front wall 107, and a rear wall 108 connected by a bottom wall 109. A somewhat U-shaped upper wall 110 connects the front and rear walls in the manner as illustrated, and as best seen in FIGS. 13–15. The somewhat U-shaped upper wall 110 actually forms a receptacle constructed and arranged so as to receive the end portion of a conventional phosphor excitable lamp. The front and rear walls 107 and 108 respectively, along with the bottom wall 109 and upper wall 110, which are all integrally formed together, form an upper load limiting electronics receiving compartment 112.

Disposed over the right-hand end of the housing 102 and rigidly secured thereto, by means of adhesives or other means known in the art, is an end wall 114. This end wall is designed to enclose the upper load limiting control electronics compartment 112.

At its left-hand end, the housing 102 is similarly provided with an end wall 118 in the manner as illustrated. The end wall 118 is typically adhesively secured to the housing 102 and is initially separated therefrom for purposes of inserting the electrical components in the load limiting control electronics component compartment 112, in the manner as hereinafter described. The end plate 118 may be suitably secured to the housing 102 by a number of known effective conventional adhesives.

Integrally formed with the lower end of the end plate 118 is an extended section 120 and which is designed with an internally formed socket 122, the latter also having a pair of spaced apart pin receiving receptacles 124. In this case, the pin receiving receptacles 124 are each located and sized so as to receive the pair of end pins on the lamp L.

The upper housing section 104 is similarly provided with a pair of outwardly struck spaced apart pins 126, which protrude through the end plate 118, and which are located and sized so as to extend into the pin receiving receptacles 127 formed in the socket 18 on the connector plate 14. Thus, it can observed that when the pins 126 are located in a position where they are rotated 90 degrees away from their final position, that is when the device is installed and retained in the socket 18, they will ultimately be rotated to the same position that the pins of a lamp would be when retained in the socket 18. Further, since the left-hand end of the lamp L has its pins located within the pin receiving receptacles 124, it will then be positioned beneath the connector plate 14 of the fixture.

Located within the load limiting control electronics component compartment 112 is a capacitor 128 and a transformer 130, the latter primarily serving as an inductive device. Furthemore, a temperature sensitive current control device, as for example, a so-called "thermal cutoff" 132 is also connected in series with the capacitor 128 and which is also connected across a primary coil 134 and a secondary coil 136 forming part of the transformer or similar inductive device. This electrical circuit arrangement is more fully schematically illustrated in FIG. 16 of the drawings.

In this embodiment of the invention, the primary effective electrical component is the capacitor 128. However, it is important that the capacitor 128 operate in conjunction with the inductive device 130 as, for example, a transformer 130. Furthermore, it is preferably, although not necessary to include the temperature control device 132 in the circuit arrangement. The temperature control device 132 operates as a switch which opens when the temperature exceeds a certain threshold level.

By further reference to FIGS. 11 through 15, it can be observed that the electrical components in the compartment 112 are electrically connected to the pins 126 and also to the pin receiving receptacles 124 in the desired electrical arrangement. In other words, the transformer interrupts the load from the source of the power directly applied to the lamp. Furthermore, the capacitor 128 is connected directly across one of the load lines and the lines to the lamp. The temperature control device is, in series with the capacitor 128 and the physical connections therefore, are more fully illustrated in FIGS. 13–15 of the drawings.

It should be observed in connection with the construction of the housing 102 that the electrical components as for example, the transformer 130, the thermistor 132 and the capacitor 128 can be easily inserted in the compartment 112, particularly, the compartment 112 prior to sealing of the end wall 118. Moreover, electrical connections can be made via the various conductors as illustrated prior to the sealing of the end wall 118. Nevertheless, after the various connections have been made, sealing of the end wall 118 insures permanent retention of the various electrical components.

In accordance with the schematic circuitry as shown, in FIG. 16 and the physical arrangement as illustrated in FIGS. 15–17, it can be observed that the capacitor 128 is again interposed in a circuit arrangement so as to alter the original electrical circuit path between the source of power and the lamp. This holds true even with the presence of the inductive device as, for example, the transformer 130 and even the inclusion of the temperature control device 132. In any event, it is apparent that the capacitor 128 is interposed in the circuit arrangement, much in the manner as previously described in connection with the instant-start circuit arrangement.

By further reference to FIGS. 9 and 10, it can be observed that the lamp L is connected between the pair of spaced apart sockets much in the manner as illustrated in connection with the instant-start arrangement. However, it should also be understood that this load limiting control device, as shown in connection with the rapid start arrangement, could be equally employed with the instant start arrangement. The only difference is that there is an offset to one end of the lamp. This is nevertheless, highly effective in that it eliminates problems of attempting to insert the lamp in a small confined space.

While it is possible to use the previously described embodiments of the invention on one end of the lamp with the capacitor connected in such a manner that this original circuit is interrupted and rearranged, it is more efficient to use this embodiment of a load limiting control device wherein one end of the lamp is physically displaced from the original socket. This permits the necessary and desirable space requirements to be achieved in terms of providing for the electronic components, connection of the pins in the lamp to the device, and connection of the device to the socket of the fixture.

When further considering FIGS. 9–10 and 12–15, it can be realized that the lamp is initially inserted within the receptacle created by upper wall 110. Thereafter, the lamp is rotated in the device until it is retained therein. Next, the pins at the opposite end of the lamps L are inserted into the socket 18' and the pins 126 are inserted in the pin receiving receptacle 127. Thereafter, the lamp and the device are simultaneously rotated along the axis of the lamp, 90 degrees so that the lamp and device ultimately end in a position as illustrated in FIG. 10 for example, that is where the left-hand end of the lamp is slightly below the original socket. In the case of the embodiment illustrated in FIG. 11, one end of the tube is laterally offset and not below the end of the next adjacent tube or lamp.

This offset arrangement is not distracting to, or even readily observable, to a viewer. Particularly, when using long length lamps as, for example, an eight foot lamp or a ten foot lamp, the fact that the left-hand end of the lamp has been displaced a matter of an inch or so from the original socket is not readily observable to a viewer. FIGS. 9, 10 and 11 have only been exagerated to more fully illustrate the mounted relationship of the lamp to the fixture.

Nevertheless, it is also realized that both lamps in a fixture, or for that matter, all of the lamps in the fixture are still operating and providing a lumen output. The very fact that the lumen output is being generated further disguises the fact that one end of the lamp may not be physically inserted in a socket of the fixture, but rather displaced a very slight amount therefrom. It is, however, this displacement which permits a very easy and convenient manufacture of the load limiting control devices of the present invention.

FIG. 12 of the drawings illustrates an embodiment of the invention where a load limiting control device 100 is used at the left-hand end of the fixture and a load limiting control device 140 is used at the right-hand end of the fixture. The load limiting control device 140 is substantially identical to the load limiting control device 100 as previously described, except for the fact that the load limitng control device 140 does not include any of the electronic components as previously described. In other words, the electrically conductive sockets 124 are connected directly to pins 126 on the upper section of the device 140. This is clearly observable in the manner as illustrated in FIG. 12 of the drawings.

The embodiment of the invention as illustrated in FIG. 12 is very similar to the embodiment of the invention as illustrated in FIGS. 13–15, of the drawings as aforesaid, as well as in FIG. 11. The only difference is that the load limiting control device 140 does not establish any different form of electrical circuit path, since the alteration of the circuit path is created by the load limiting control device 100. Hence, when using both load limiting control device 100 and the load limiting control device 140, an identical electrical path is achieved even as if the load limiting control device 140 were not employed. The advantage of the load limiting control device 140 is that it acts as a companion to the device 110 and permits both ends of the lamp to be located essentially at the same elevation.

Returning now to the electrical circuit arrangement, it can be observed that the impedance of all of the components of the circuit effectively constitutes the major part of the total resistance in the circuit. The capacitive member as, for example, the capacitor 128 is clearly a major component in the circuit which alters the electrical circuit path and this capacitor 128 restricts the current flow in the circuit. The inductor as, for example, the transformer 130, is primarily designed to maintain the filament voltage. The capacitor, on the other hand, is effectively designed to match the impedance of the circuit back to the ballast itself.

The device which is interposed between the lamp and the fixture to alter the circuit arrangement is truly an impedance corrective device inasmuch as the tube makes a contact with the fixture and with the load limiting control device, the ballast effectively believes that it has a lower impedance than is really the case. Consequently, a reduced current flow is generated from the ballast.

Notwithstanding any of the foregoing, it is realized that the load limiting control device of the present invention, and in the particular embodiments as illustrated in FIGS. 9–16 are highly effective. In one specific embodiment of the device 100, the housing 102, has an overall vertical dimension of approximately two inches, the end walls 114 and 118 each have an approximate thickness of about 0.080 inches in maximum. In addition, the socket formed by the wall 108 has a radius of approximately 0.750 inches. Further, the diametral center point of the socket is spaced from the lower edge of the housing 102 by approximatexly 1.0 inches.

FIG. 19 illustrates a socket arrangement using one standard form of rapid start ballast designated by reference numeral 142. The ballast is connected to a pair of lamps $L_1$ and $L_2$ with the load limiting control device inserted with respect to the lamp $L_1$ in the manner as illustrated. Tests conducted with the load limiting control device used in conjunction with the rapid start circuit arrangement have shown that the device is equally as efficient as with the previously described instant start circuit arrangement. However, in connection with the rapid start circuit arrangement, it has been found that the most efficient results have been obtained when the capacitor 128 has a value of approximately 3.5 microfarads.

In one of the embodients of the invention, as described, a 4 microfarad capacitor was used in the device and was connected in series with one of the fluorescent lamps in a two lamp fixture. The lamps gave off 65 foot candles with a 0.80 amp and 120 volt power source and which created 88 watts of active power. However, there was 97.2 watts of apparent power. The power factor was approximately 90.5% with an apparent 53% savings in energy.

In another embodiment, a 5 microfarad capacitor was used with an input power of 0.80 amps and a 120 volts presenting 96 watts of active power. In this case, it was determined that there was a 100% power factor with no loss of power whatsoever but with a significant reduction in the amount of power used to illuminate the lamps.

With a 2 microfarad capacitor, it was found generally that the power was reduced about 50% although the lumen output was reduced approximately 60%. Therefore, while the invention is operable with capacitors having a capacitive value of less than 33 microfarads and greater than 6 microfarads it is preferable to employ capacitors within the range of 4 to 5 microfarads.

Thus, there has been illustrated and described a unique and novel means and method for reducing lumen output and power consumption of a phosphor excitable lamp in a single lamp or plural lamp arrangement without any appreciable effect on efficiency of the lamp or power source therefor. Thus, the present invention fulfills all of the objects and advantages sought therefore. It should be understood that many changes, modifications, variations, and other uses and applications will become apparent to those skilled in the art after considering this specification and the accompanying drawings. Therefore, any and all such changes, modifications, and other uses which do not depart from the spirit and scope of the invention are deemed to be covered by the invention which is limited only by the following claims.

Having thus described my invention, what I desire to claim and secure by Letters Patent is:

1. A means for limiting power consumption and lumen output of a conventional phosphor excitable lamp connected to a source of power for operation of same without any appreciable loss in efficiency of operation, said means comprising:

a load limiting control device electrically connectable to one terminal of said conventional phosphor excitable lamp and to a socket which received said lamp so as to be effectively electrically interposed between said lamp and source of power in a series connection, said control device being constructed so that it has a first section capable of fitting with respect to said socket and a second section offset from said first section and adapted to receive the end of said lamp where it was received by said socket so that one end of said lamp is slightly offset from said socket, said device comprising a capacitive means selected with a capacitive value so that the lumen output at the reduced level and the power consumption is reduced without substantially changing the voltage to the lamp and without any appreciable effect on the efficiency of operation of said lamp or source of power.

2. The means for limiting power consumption and lumen output of claim 1 further characterized in that said load limiting control device is capable of being electrically connected without connecting or disconnecting anything other than said lamp.

3. The means for limiting power consumption and lumen output of claim 1 further characterized in that said capacitive means has a capacitive value from about eight microfarads to about fourteen mircofarads.

4. The means for limiting power consumption and lumen output of claim 1 further characterized in that said first section comprises a first conductive element electrically connectable to a conductive receptacle in said socket and said second section comprises a conductive receptacle to receive a conductive pin on said lamp and a capacitor means connected across said conductive element and conductive receptacle in said second section.

5. The means for limiting power consumption and lumen output of claim 4 further characterized in that said first conductive element and receptacle in said second section are electrically connected to said capacitive means.

6. The means for limiting power consumption and lumen output of claim 1 further characterized in that said device is used to limit power consumption and lumen output of a plurality of phosphor excitable lamps in a series circuit arrangement of such lamps with repect to each other and with respect to a source of power for operation of said lamps, said device being adapted to be interposed between one of the lamps and the source of power.

7. The means for limiting power consumption and lumen output of claim 1 further characterized in that said lamp is a flourescent lamp.

8. A load limiting means for limiting power consumption and correspondingly limiting lumen output of a conventional phosphor excitable lamp removably retained in a fixture having a pair of spaced apart sockets with each having a conductive terminal and which sockets retain and connect conductive end terminals of a conventional phosphor excitable lamp, said load limiting means comprising:

(a) a housing having a first section sized and shaped so as to be capable of fitting in one of said sockets and a first conductive element connectable to a conductive terminal in said socket, (b) a second section of said housing having a portion sized and shaped similar to a socket so as to be capable of receiving an end of the lamp, and having a second conductive element connectable to a conductive end terminal of said lamp, (c) a load limiting electrical element in said housing and connected to the two conductive elements so that said device creates a circuit path not created directly between the conductive terminal of the socket and the end terminal of the lamp but rather through the load limiting means, to thereby limit power consumption and lumen output without appreciably affecting efficiency of operation of said lamp.

9. The load limiting means of claim 8 further characterized in that said load limiting electrical element is a capacitive means which is effectively electrically interposed between a source of electrical power for said lamp and said lamp, said capacitive means being selected with a capacitive value so that the lumen output is reduced but with substantially uniform lumen output at the reduced level and the power consumption is reduced without substantially changing the voltage to the lamp and without any appreciable effect on the efficiency of operation of said lamp or source of power.

10. The means for limiting power consumption and lumen output of claim 8 further characterized in that said means consists essentially of said capacitive means and an inductive means.

11. The means for limiting power consumption and lumen output of claim 8 further characterized in that said capacitive means has a capacitive value from about two microfarads to about fourteen microfarads.

12. The means for limiting power consumption and lumen output of claim 8 further characterized in that said capacitive means has a capacitive value from about eight microfarads to about twelve microfarads.

13. The load limiting means for limiting power consumption and lumen output of claim 9 further characterized in that:

(a) said first conductive element is a pin adapted to fit within a conductive receptacle in said socket and establish electrical connection with said socket, (b) said second conductive element is a socket adapted to receive a pin on said lamp and establish electrical connection with a conductive terminal of said lamp, and (c) an electrically conductive member between said first and second conductive elements electrically connecting same to said capacitive means.

14. The means for limiting power consumption and lumen output of claim 9 further characterized in that said load limiting means is used to limit power consumption and lumen output of a plurality of phosphor excitable lamps in a series circuit arrangement of such lamps with respect to each other and with respect to a source of power for operation of said lamps, said means being adapted to be interposed between the conductive terminal of at least one of the sockets and the end terminal of the lamp at that socket.

15. The means for limiting power consumption and lumen output of claim 9 further characterized in that said lamp is a fluorescent lamp.

16. The load limiting means of claim 8 further characterized in that said first and second sections of said housing are integrally formed as a unitary structure, said first section having a portion to fit with a socket of a fixture, said second section having a partial cylindrical section similar to a socket to receive an end of a lamp.

17. A means for use with and for limiting power consumption amd lumen output of a conventional phosphor excitable lamp connected to a source of power for operation of same without any appreciable loss in efficiency of operation, said means comprising:

a load limiting control means operatively interposed between a conductive end terminal of said conventional phosphor excitable lamp and a socket which received the end terminal of said lamp, said load limiting control means also being electrically connectable to said one conductive end terminal of said phosphor excitable lamp and a conductive terminal in said socket and thereby effectively electrically interrupting the connection between the conductive end terminal of the lamp and end terminal of the socket so as to be electrically interposed between said same conventional lamp and source of power in a series connection and so that said lamp remains in circuit relation to said source of power, said load limiting control comprising a transformer having a primary and a secondary winding and capacitive means operatively connected with respect said primary and secondary windings so that the lumen output at the reduced level and the power consumption is reduced without substantially changing the voltage to the lamp and without any appreciable effect on the efficiency of the operation of said lamp or source of power.

18. The means for limiting power consumption and lumen output of claim 17 further characterized in that said means is capable of being electrically connected without connecting or disconnecting anything other than said lamp.

19. The means for limiting power consumption and correspondingly limiting lumen output of claim 17 further characterized in that said capacitive means is connected between said primary winding and said secondary winding.

20. An insertable means for use with and for limiting power and correspondingly limting lumen output of a conventional phosphor excitable lamp removably retained in a fixture having a pair of spaced apart sockets with each socket having a conductive terminal and which sockets retain and connect conductive end terminals of a conventional phosphor excitable lamp, said insertable means comprising:

a capacitive-transformer circuit arrangement operatively interposed between the conductive terminal in at least one of the sockets and the end terminal of the lamp at that socket and also retaining the lamp between the spaced apart sockets such that a circuit path originally between the conductive end terminal of the lamp and conductive terminal of that socket is no longer created directly between the conductive terminal of that socket and the end terminal of the lamp but rather through the capacitive-transformer circuit arrangement, to thereby limit power consumption and lumen output without appreciably affecting efficiency of operation of said lamp, and where said insertable means can be removed with the lamp remaining in or being reconnected between the pair of spaced apart sockets so that the lamp lumen output will increase to its original amount.

21. The means for limiting power consumption and correspondingly limiting lumen output of claim 20 further characterized in that said capacitive-transformer circuit arrangement is effectively electrically interposed between said lamp and a source of electrical power for said lamp and a capacitive means forming part of said circuit arrangement being selected with a capacitive value so that the lumen output is reduced but with substantially uniform lumen output at the reduced level and the power consumption is reduced without substantially changing the voltage to the lamp and without any appreciable effect on the efficiency of operation of said lamp or source of power.

22. A load limiting device for limiting power consumption and correspondingly limiting lumen output of a conventional phosphor excitable lamp removably retained in a fixture having a pair of spaced apart sockets with each having a conductive terminal and which sockets retain and connect conductive end terminals of a conventional phosphor excitable lamp, said load limiting device comprising:

(a) a first housing section having a portion with a shape similar to an end portion of a phosphor excitable lamp and capable of fitting in one of said sockets, said first housing section having a first conductive pin-like element connectable to a conductive terminal in said socket, (b) a second housing section having a portion with a shape similar to that of a socket in a fixture and capable of receiving an end of the lamp, said second housing sections having a second conductive element connectable to a conductive end terminal of said lamp, and (c) a load limiting electrical element operatively associated with housing sections and connected to the two conductive elements so that said device creates a circuit path not created directly between the conductive terminal of the socket and the end terminal of the lamp but rather through the load limiting means, to thereby limit power consumption and lumen output without appreciably affecting efficiency of operation of said lamp.

23. The load limiting means of claim 22 further characterized in that said load limiting electrical element is a capacitive means which is effectively electrically interposed between a source of electrical power for said lamp and said lamp, said capacitive means being selected with a capacitive value so that the lumen output is reduced but with substantially uniform lumen output at the reduced level and the power consumption is reduced without substantially changing the voltage to the lamp and without any appreciable effect on the efficiency of operation of said lamp or source of power.

24. The load limiting means for limiting power consumption and lumen output of claim 22 further characterized in that said means consists essentially of said capacitive means and an inductive means.

25. The load limiting means for limiting power consumption and lumen output of claim 23 further characterized in that:

(a) said first conductive element is a pin adapted to fit within a conductive receptacle in said socket and establish electrical connection with said socket, (b) said second conductive element is a socket adapted to receive a pin on said lamp and establish electrical connection with a conductive terminal of said lamp, and (c) an electrically conductive member between said first and second conductive elements electrically connecting same to said capacitive means.

26. The means for limiting power consumption and lumen output of claim 23 further characterized in that said load limiting means is used to limit power consumption and lumen output of a plurality of phosphor excitable lamps in a series circuit arrangement of such lamps with respect to each other and with respect to source of power for operation of said lamps, said means being adapted to be interposed between the conductive terminal of at least one of the sockets and the end terminal of the lamp at that socket.

* * * * *